United States Patent [19]

Gerlach

[11] Patent Number: 4,934,077

[45] Date of Patent: Jun. 19, 1990

[54] ARTICULATED VISUAL DISPLAY KIT

[76] Inventor: Philip Gerlach, 3179 Manley La., Lompoc, Calif. 93436

[21] Appl. No.: 253,129

[22] Filed: Oct. 4, 1988

[51] Int. Cl.[5] ..... A47G 1/16

[52] U.S. Cl. ..... 40/152.1; 248/480; 40/661

[58] Field of Search ..... 40/152, 152.1, 661, 40/605, 210; 248/480, 476, 475.1; 403/61, 80, 87, 84

[56] References Cited

U.S. PATENT DOCUMENTS

| | | | |
|---|---|---|---|
| 2,317,708 | 4/1943 | Zareko | 248/480 |
| 3,384,987 | 5/1968 | Prechtl | 40/152.1 |
| 3,709,585 | 1/1973 | Tsai | 403/61 |
| 3,828,457 | 8/1974 | Willis | 40/152.1 |
| 3,865,342 | 2/1975 | Kanzelberger | 40/152.1 |
| 4,123,862 | 11/1978 | Dyer et al. | 40/152 |
| 4,441,268 | 4/1984 | Scott | 40/661 |

*Primary Examiner*—Cary E. Stone

*Attorney, Agent, or Firm*—Michael G. Petit

[57] ABSTRACT

A kit for the versatile display of pictures which includes: (a) one or more frame members into which photographs or similar works of art can be easily inserted; (b) a slotted track to which one or more frame members may be adjustably attached; and (c) finger-adjustable wing-bolts to hold a frame member and one or more slotted tracks together. The kit also includes a wall-hanging member which may be easily and adjustably positioned near the center of gravity of the finished display.

2 Claims, 2 Drawing Sheets

ARTICULATED VISUAL DISPLAY KIT

BACKGROUND OF THE INVENTION

1. Field of the Invention

This invention relates to means of displaying works of art such as photographs, and more particularly relates to improved decorative three dimensional sculptural display means and to kits for fabricating the same.

2. Prior Art

The systematic storing of photographic prints is a problem nearly everyone has encountered. The problem is most frequently solved by employing a photograph album; or simply by stacking the photos together and binding with an elastic band. These worthy remedies to the photo storage/display problem are not without merit—they are cheap. Unfortunately, these methods also place the photos out of sight unless a particular effort is made to view them.

Means for more effectively and more frequently displaying such photos and the like, especially if simple and inexpensive, would be well received by photographers. Moreover, if such display means could present a set of carefully selected photographs in a manner which could be customized to an individual's taste and which could also result in a decorative sculptural display, the whole would be greater than the sum of its parts.

Dyer et al (U.S. Pat. No. 4,123,862) in an attempt to solve this problem teaches the use of a display kit which enables the user to glue photographs (or other material containing visual indicia on one side) to each other to form an array. Spacer blocks are used to separate adjacent photographs providing a three-dimensional effect. Unfortunately, while the method provides an inexpensive display means, it lacks flexibility. If, for example, after a photographic display such as a family album is constructed, it is desirable to insert a photograph of Uncle Freddy next to the picture of mom, but mom's picture is in the interior of the display, the insertion of Uncle Freddy's picture could only be accomplished with great difficulty.

Zareko, in U.S. Pat. No. 2,317,708, describes an assembly for the display of pictures employing hinges between frame members which is expandable. Zareko's assembly is designed to display a plurality of pictures in intersecting planes and is unsuitable for wall hanging.

The present invention teaches the repetitive use of three simple inexpensive components to construct a versatile three-dimensional sculptural array which can be quickly assembled and modified without tools. Addition of a fourth component provides means for attaching the finished display to a wall.

SUMMARY OF THE INVENTION

A kit is provided which includes (a) a plurality of frame members into which photographs or similar works of art can be easily inserted; (b) at least one slotted track to which one or more frame members may be rigidly attached; and (c) adjustable means for holding the frame member and slotted track together. In the preferred embodiment a threaded bolt, which may be finger-tightened, mates with female threads in a reinforced section of the frame member. The invention includes an additional wall-hanging member which may be easily and adjustably positioned near the center of gravity of the finished display to provide a convenient means for mounting the display on a wall. These features are set forth in the following detailed description and accompanying drawings.

DRAWINGS

DETAILED DESCRIPTION

Figure 1:
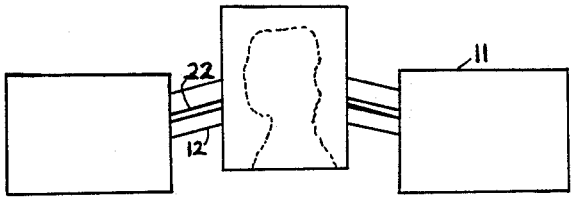
FIG. 1 is a schematic front elevation of the preferred embodiment of the present invention showing three frame members.
Figure 2:
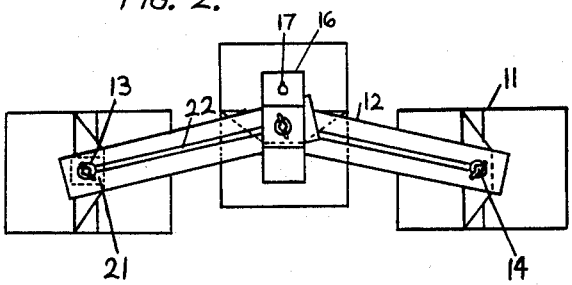
FIG. 2 is a schematic rear elevation of the preferred embodiment of FIG. 1.

In FIG. 1, an example of a preferred embodiment containing three frame members (11) and two slotted tracks (12) is presented. All mounting hardware and structural features other than the frame members and slotted tracks are out of sight when viewed from the front. FIG. 2 is a rear view of FIG. 1.

Figure 3:
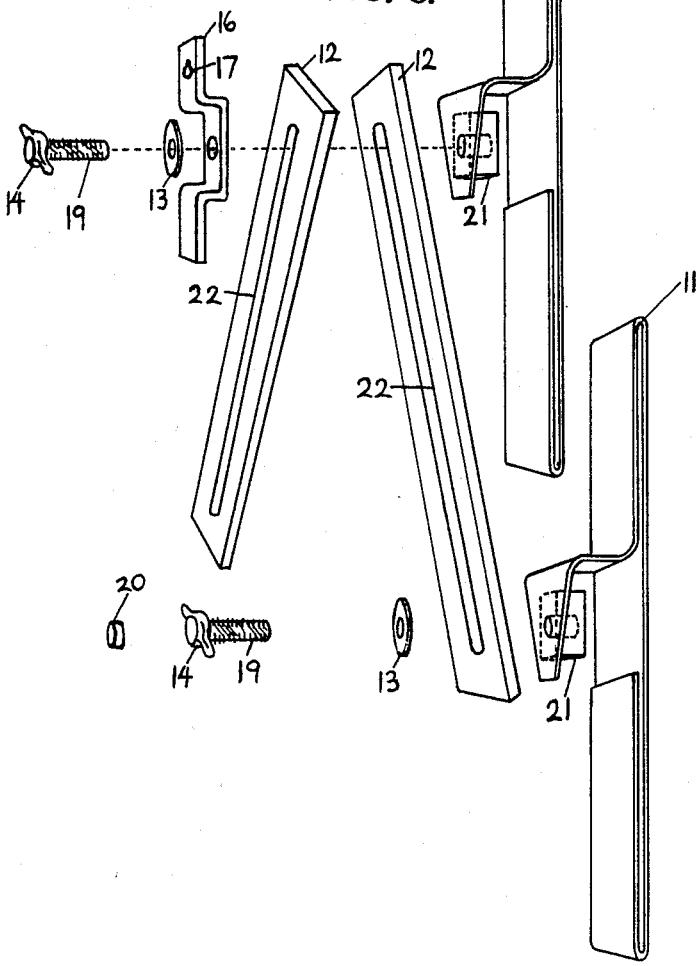
FIG. 3 is a schematic side plan view of the assembly of FIG. 1 and FIG. 2.

Turning now to FIG. 3, a detailed plan view of the basic elements of the display is revealed. Two slotted tracks (12) are joined first together by means of a finger tightened bolt (14) which passes through a washer, (13) which washer serves to distribute the pressure from the head of the wing bolt (14) over a larger area on the surface of the slot (12); a hanging member, optional slots (22) in the slotted track and through a hole in the rear of the frame member (11), which hole may either be threaded to receive the bolt (14) or which may be backed by a hexagonal recess molded into a reinforced section of the frame member to receive a hexagonal nut. The slotted tracks are adjusted to the desired angle and the bolt is turned down finger tight. It is not necessary to join the slotted tracks together behind a frame member (11) but doing so hides the fastening hardware from view once a picture is placed in the frame member.

Figure 4:
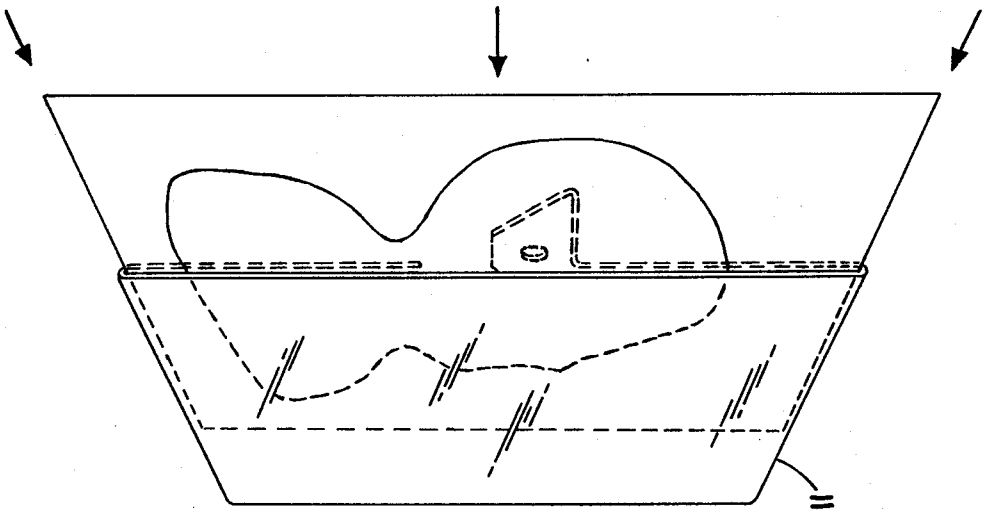
FIG. 4 is a perspective drawing showing how a picture or other visual indicia slides into the frame member.

The frame member (11) is bent from a single sheet of 1/16–⅛ inch acrylic plastic sheet. A pocket is formed during bending to receive and securely hold a picture by friction as shown in FIG. 4. The bolt-receiving reinforcement (21) on the rear of the frame member is fastened to the frame member by means of acrylic adhesive. In the preferred embodiment, the bolt-receiving reinforcement (21) is drilled and tapped to receive the bolt (14) and is of matching thread to the bolt (19). Alternatively, it is obvious that the bolt-receiving member may be drilled to accommodate passage of the bolt and recessed to accommodate a hexagonal or square nut.

It is desirable to establish the initial joint between slotted tracks as the center of gravity of the finished display. Accordingly, a hanging member (16) is disposed behind the joint as shown in FIG. 3. Additional slotted tracks may then be added as desired to the starter tracks, omitting the hanging member (16) from subsequent joints.

Frame members, once attached to the skeleton of slotted tracks as described above, will all lie in one or more parallel planes. A bumper (20) such as a felt pad or silicone pellet may be placed on the bottom of hanging member (16) by means of adhesive to provide a point of friction with the wall to inhibit rotation of the display when it is hung on the wall by means of the hole (17) in the hanging member (16).

The foregoing description of the preferred embodiment is given by way of example and is not intended to limit the scope of the invention. The scope of invention is more clearly set forth and circumscribed by the claims.

What I claim is:

1. A kit containing a combination of elements which, when used together, enable the manual assembly of a versatile expandable structure for wall hanging and displaying visual works of art such as photographs, prints or posters, wherein each work of art is in substantially the same or parallel planes so they may be viewed together from a single viewpoint, said elements comprising:

(a) a frame member having a viewing side and a rear side, said frame member providing means for the support and display of visual work, said frame member having means for attachment to a frame supporting member affixed to the rear side of said frame member;

(b) a frame supporting member comprising a slotted track;

(c) means for adjustable connection of the frame supporting member to a similar frame supporting member;

(d) a fastener for holding said means for attachment and said frame supporting member adjustably together; and (e) a hanging member.

2. As in claim 1 wherein said frame member is fabricated from a single sheet of clear acrylic plastic.

* * * * *